US007191616B2

(12) United States Patent
Kim et al.

(10) Patent No.: US 7,191,616 B2
(45) Date of Patent: Mar. 20, 2007

(54) FRONT SUCTION/DISCHARGE TYPE OUTDOOR UNIT FOR AIR-CONDITIONER AND OUTDOOR UNIT INSTALLATION SYSTEM USING IT

(75) Inventors: In-Gyu Kim, Jinhae-Shi (KR); Young-Ju Bae, Changwon-Shi (KR); Ja-Hyung Koo, Changwon-Shi (KR); Byung-Il Park, Changwon-Shi (KR); Kyeong-Ho Kim, Changwon-Shi (KR); Yang-Ho Kim, Changwon-Shi (KR); Young-Ho Hong, Kimhae-Shi (KR); Kyeong-Wook Heo, Changwon-Shi (KR); Kang-Wook Cha, Changwon-Shi (KR); Si-Kyong Sung, Changwon-Shi (KR); Dong-Hyuk Lee, Jinhae-Shi (KR); Seong-Min Kang, Seoul (KR); Tae-Geun Kim, Changwon-Shi (KR)

(73) Assignee: LG Electronics Inc., Seoul (KR)

( * ) Notice: Subject to any disclaimer, the term of this patent is extended or adjusted under 35 U.S.C. 154(b) by 123 days.

(21) Appl. No.: 10/473,071

(22) PCT Filed: Jun. 9, 2003

(86) PCT No.: PCT/KR03/01122

§ 371 (c)(1),
(2), (4) Date: Sep. 26, 2003

(87) PCT Pub. No.: WO2004/094917

PCT Pub. Date: Nov. 4, 2004

(65) Prior Publication Data

US 2004/0244409 A1 Dec. 9, 2004

(30) Foreign Application Priority Data

Apr. 23, 2003 (KR) ..... 10-2003-0025816
Apr. 23, 2003 (KR) ..... 10-2003-0025817
May 2, 2003 (KR) ..... 10-2003-0028212

(51) Int. Cl.
*F25B 39/04* (2006.01)

(52) U.S. Cl. ..... 62/508

(58) Field of Classification Search ..... 62/259.1, 62/404, 507, 428, 508; 454/313, 316, 241, 454/243, 233, 234
See application file for complete search history.

(56) References Cited

U.S. PATENT DOCUMENTS

| | | | | | |
|---|---|---|---|---|---|
| 3,128,610 | A | * | 4/1964 | Moore | 62/263 |
| 3,729,952 | A | * | 5/1973 | Macleod | 62/428 |
| 4,307,776 | A | * | 12/1981 | Grun et al. | 165/48.2 |
| 4,544,023 | A | * | 10/1985 | Marciniak | 165/48.1 |
| 4,738,116 | A | | 4/1988 | Himeno et al. | |
| 5,890,484 | A | * | 4/1999 | Yamada | 126/299 R |
| 6,431,979 | B1 | * | 8/2002 | Asbjornson et al. | 454/233 |
| 6,745,589 | B2 | * | 6/2004 | Katatani et al. | 62/259.1 |
| 2004/0237559 | A1 | * | 12/2004 | Kim et al. | |

FOREIGN PATENT DOCUMENTS

| | | | |
|---|---|---|---|
| GB | 1248049 | * | 10/2002 |
| JP | 53-103255 | | 9/1977 |
| JP | 03-213928 | | 9/1991 |
| JP | 06-101873 | | 4/1994 |
| JP | 6-137601 | * | 5/1994 |
| JP | 09-170786 | | 6/1997 |
| KR | 1020020039485 A | * | 5/2002 |
| WO | WO 03027578 | | 4/2003 |

OTHER PUBLICATIONS

International Search Report dated Sep. 7, 2004.

* cited by examiner

*Primary Examiner*—Mohammad M. Ali
(74) *Attorney, Agent, or Firm*—Fleshner & Kim LLP

(57) ABSTRACT

The present invention discloses a front suction/discharge type outdoor unit for an air conditioner including: an outdoor unit casing being formed in a rectangular parallelepiped shape, having its one surface externally opened and its other surfaces closed, and being divided into a suction unit and a discharge unit; a compressor installed in the outdoor unit casing, for compressing a refrigerant gas supplied from an indoor unit through pipe lines; an air-cooled condenser positioned in the outdoor unit casing, for condensing the refrigerant gas from the compressor; and a sirocco cooling fan installed in the outdoor unit casing, for forming a diffuser opposite side part of a curvature unit of a housing as a plane unit, forming the fan housing to separate a diffuser opposite side member from a diffuser side member, supplying external air to the air-cooled condenser, and discharging heat exchanged air. A discharge direction of air from the sirocco cooling fan becomes more distant from the most adjacent outdoor unit.

22 Claims, 8 Drawing Sheets

FRONT SUCTION/DISCHARGE TYPE OUTDOOR UNIT FOR AIR-CONDITIONER AND OUTDOOR UNIT INSTALLATION SYSTEM USING IT

TECHNICAL FIELD

The present invention relates to an outdoor unit for an air conditioner, and more particularly to, a front suction/discharge type outdoor unit for an air conditioner, and an outdoor unit installation system using the same.

BACKGROUND ART

An air conditioner implying a cooler, a heater or both of them is classified into a window type and a split type. In the case of the cooler, a split type air conditioner includes an indoor unit installed indoors for cooling a room, and an outdoor unit connected to the indoor unit through refrigerant pipe lines and installed outdoors to contact air, for performing condensation heat exchange on a refrigerant gas in a condenser by using external air as a cooling medium, and supplying the condensed refrigerants to an evaporator of the indoor unit through the refrigerant pipe lines. The indoor unit is composed of the evaporator for performing cooling heat exchange for evaporating the refrigerants and absorbing evaporation heat from internal air, and a ventilating fan for circulating internal air, and the outdoor unit is composed of a compressor for compressing the refrigerant gas and supplying the compressed gas to the condenser, the air-cooled condenser for condensing the refrigerant gas from the compressor, and a cooling fan for forcibly ventilating external air to the air-cooled condenser to cool and condense the refrigerant gas. The compressor, the air-cooled condenser and the cooling fan of the outdoor unit are installed in an outdoor unit casing composing the outer appearance. The conventional hexahedral outdoor unit casing has an air suction unit for sucking air to the air-cooled condenser at its three sides, and an air discharge unit for externally discharging air absorbing condensation heat from the refrigerant gas by the heat exchange in the air-cooled condenser on its top surface.

However, the conventional outdoor unit for the air conditioner is restricted in installation spaces due to high density and strict environment regulations of cities, and increases civil applications due to noise and heat. Especially, a common residential area such as large-scaled apartment buildings regulates the outdoor units to be installed in indoor verandas to improve the appearance and prevent noise.

In order to solve the foregoing problems, Japanese Laid-Open Patent Publication 6-101873 suggests an air conditioner mounted building where an indoor unit of an air conditioner is installed indoors or adjacent to a room intended to be air-conditioned, and an outdoor unit of the air conditioner is installed outdoors, wherein an opening is formed on the outer wall or roof, a louver is installed in the opening, the outdoor unit of the air conditioner is positioned in the louver, and suction/discharge of the indoor unit is performed through a gap between louver plates.

In addition, Japanese Laid-Open Patent Publication 3-213928 discloses a wall built-in type outdoor unit for an air conditioner including an outdoor unit main body for the air conditioner which is built in the wall and which includes a frame having the same size and thickness as the wall, a suction hole for heat exchange air installed on the same surface as the outdoor unit main body, and a discharge hole for heat exchanged air.

However, the conventional arts relate merely to technologies for inserting the outdoor unit into a space formed on an outer wall of a building. That is, there has never been suggested a structure suitable for a common residential building using a plurality of built-in or front suction/discharge type outdoor units, or a structure for efficiently installing or repairing the outdoor units.

Moreover, when the outdoor unit increased in size due to large air conditioning capacity is formed in a front suction/discharge type, the outdoor unit has a smaller suction unit area than a conventional three-surface suction type outdoor unit, to increase a suction resistance and reduce heat exchange efficiency.

DISCLOSURE OF THE INVENTION

An object of the present invention is to provide an outdoor unit structure which can minimize reduction of heat exchange efficiency of an outdoor unit by an adjacent outdoor unit and reduction of heat exchange efficiency of the adjacent outdoor unit by the outdoor unit in a common residential building in which a plurality of front suction/discharge type outdoor units for air conditioners are installed.

Another object of the present invention is to minimize reduction of a suction resistance by installing a sirocco cooling fan in a front suction/discharge type outdoor unit for an air conditioner, and provide a large capacity sirocco cooling fan in a restricted area of the outdoor unit.

Yet another object of the present invention is to provide an installation structure for efficiency installing a sirocco cooling fan, and a cooling fan structure for easily installing and repairing the sirocco cooling fan.

Yet another object of the present invention is to provide an outdoor unit installation system which can minimize interferences between front suction/discharge type outdoor units installed in each house of a large common residential building.

In order to achieve the above-described objects of the invention, there is provided a front suction/discharge type outdoor unit for an air conditioner including: an outdoor unit casing being formed in a rectangular parallelepiped shape, having its one surface externally opened and its other surfaces closed, and being divided into a suction unit and a discharge unit; a compressor installed in the outdoor unit casing, for compressing a refrigerant gas supplied from an indoor unit through pipe lines; an air-cooled condenser positioned in the outdoor unit casing, for condensing the refrigerant gas from the compressor; and a sirocco cooling fan installed in the outdoor unit casing, for forming a diffuser opposite side part of a curvature unit of a housing as a plane unit, forming the fan housing to separate a diffuser opposite side member from a diffuser side member, supplying external air to the air-cooled condenser, and discharging heat exchanged air, wherein a discharge direction of air from the sirocco cooling fan becomes more distant from the most adjacent outdoor unit.

According to another aspect of the invention, a front suction/discharge type outdoor unit for an air conditioner includes: an outdoor unit casing being formed in a rectangular parallelepiped shape, having its one surface externally opened and its other surfaces closed, and being divided into a suction unit and a discharge unit; a compressor installed in the outdoor unit casing, for compressing a refrigerant gas supplied from an indoor unit through pipe lines; an air-cooled condenser positioned in the outdoor unit casing, for condensing the refrigerant gas from the compressor; and a cooling fan installed in the outdoor unit casing, for supplying external air to the air-cooled condenser, and discharging heat exchanged air, wherein a discharge direction of air from the cooling fan becomes more distant from the most adjacent outdoor unit.

Here, the cooling fan is a sirocco cooling fan, and a diffuser opposite side part of a curvature unit of a cooling fan housing is formed as a plane unit, or the cooling fan housing is formed to separate a diffuser opposite side member from a diffuser side member. In this case, preferably, the cooling fan is a sirocco cooling fan, and one of suction orifices of the cooling fan faces the surface contacting with one opened surface facing a discharge area of a louver frame and being farthest from the suction unit among the other surfaces, and the other orifice faces the suction unit. More preferably, the outdoor unit further includes a louver frame, and the louver frame is installed on a rectangular space inner wall formed on an outer wall of a building to face the suction unit and the discharge unit of the outdoor unit casing, is divided into a suction area and a discharge area corresponding to the suction unit and the discharge unit of the outdoor unit casing, includes a plurality of louver blades in each area, and sucks and discharges air through gaps between the louver blades. Here, more preferably, the louver blades of the discharge unit are installed in a length direction, and a rotation direction of a sirocco cooling fan motor is opposite to a rotation direction of a sirocco cooling fan motor of the most adjacent outdoor unit.

According to another aspect of the invention, a front suction/discharge type outdoor unit for an air conditioner includes: an outdoor unit casing being formed in a rectangular parallelepiped shape, having its one surface externally opened and its other surfaces closed, and being divided into a suction unit and a discharge unit; a compressor installed in the outdoor unit casing, for compressing a refrigerant gas supplied from an indoor unit through pipe lines; an air-cooled condenser positioned in the outdoor unit casing, for condensing the refrigerant gas from the compressor; and a sirocco cooling fan installed in the outdoor unit casing, for forming a diffuser opposite side part of a curvature unit of a housing as a plane unit, supplying external air to the air-cooled condenser, and discharging heat exchanged air.

Here, a discharge direction of air from the cooling fan becomes more distant from the most adjacent outdoor unit, and the fan housing is formed to separate a diffuser opposite side member from a diffuser side member. In this case, the sirocco cooling fan is fixed by a fan bracket extended from a discharge unit frame to an opposite side discharge unit frame after contacting with the plane unit of the fan housing. More preferably, the sirocco cooling fan is closely adhered to the inside surface of the casing facing the plane unit of the fan housing.

According to another aspect of the invention, a front suction/discharge type outdoor unit for an air conditioner includes: an outdoor unit casing being formed in a rectangular parallelepiped shape, having its one surface externally opened and its other surfaces closed, and being divided into a suction unit and a discharge unit; a compressor installed in the outdoor unit casing, for compressing a refrigerant gas supplied from an indoor unit through pipe lines; an air-cooled condenser positioned in the outdoor unit casing, for condensing the refrigerant gas from the compressor; and a sirocco cooling fan installed in the outdoor unit casing, for forming a fan housing to separate a diffuser opposite side member from a diffuser side member, supplying external air to the air-cooled condenser, and discharging heat exchanged air.

Here, a discharge direction of air from the cooling fan becomes more distant from the most adjacent outdoor unit, and a diffuser opposite side part of a curvature unit of the cooling fan housing is formed as a plane unit. Preferably, the diffuser opposite side member is separated from the diffuser side member toward the closed surface facing one opened surface. In addition, preferably, flange units are respectively formed in the diffuser side member and the diffuser opposite side member, and the diffuser side member and the diffuser opposite side member are fastened to each other by using the flange units. Preferably, the diffuser opposite side member is separated in a state where a sirocco cooling fan motor and a fan blade unit are coupled to the diffuser opposite side member. In this case, when the diffuser side member and the diffuser opposite side member are coupled to each other, a flange unit for covering the edge of the fan blade unit is formed in the diffuser side member.

According to another aspect of the invention, an outdoor unit installation system installs on each floor a plurality of front suction/discharge type outdoor units for air conditioners respectively including: an outdoor unit casing being formed in a rectangular parallelepiped shape, having its one surface externally opened and its other surfaces closed, and being divided into a suction unit and a discharge unit; a compressor installed in the outdoor unit casing, for compressing a refrigerant gas supplied from an indoor unit through pipe lines; an air-cooled condenser positioned in the outdoor unit casing, for condensing the refrigerant gas from the compressor; and a cooling fan installed in the outdoor unit casing, for supplying external air to the air-cooled condenser, and discharging heat exchanged air, wherein discharge directions of air from the cooling fans of the outdoor units become more distant from the most adjacent outdoor units.

Here, the cooling fan is a sirocco cooling fan, and a diffuser opposite side part of a curvature unit of a cooling fan housing is formed as a plane unit, or the cooling fan housing is formed to separate a diffuser opposite side member from a diffuser side member. In any case, preferably, the cooling fan is a sirocco cooling fan, and one of suction orifices of the cooling fan faces the surface contacting with one opened surface facing a discharge area of a louver frame and being farthest from the suction unit among the other surfaces, and the other orifice faces the suction unit. Here, the outdoor unit further includes a louver frame, and the louver frame is installed on a rectangular space inner wall formed on an outer wall of a building to face the suction unit and the discharge unit of the outdoor unit casing, is divided into a suction area and a discharge area corresponding to the suction unit and the discharge unit of the outdoor unit casing, includes a plurality of louver blades in each area, and sucks and discharges air through gaps between the louver blades. Here, more preferably, the louver blades of the discharge unit are installed in a length direction, and a rotation direction of a sirocco cooling fan motor is opposite to a rotation direction of a sirocco cooling fan motor of the most adjacent outdoor unit.

The sirocco cooling fan is fixed by a fan bracket extended from a discharge unit frame to an opposite side discharge unit frame after contacting with the plane unit of the fan housing. In addition, the sirocco cooling fan is closely adhered to the inside surface of the casing facing the plane unit of the fan housing.

The diffuser opposite side member is separated from the diffuser side member toward the closed surface facing one opened surface. Preferably, flange units are respectively formed in the diffuser side member and the diffuser opposite side member, and the diffuser side member and the diffuser opposite side member are fastened to each other by using the flange units. The diffuser opposite side member is separated in a state where a sirocco cooling fan motor and a fan blade unit are coupled to the diffuser opposite side member. In this case, when the diffuser side member and the diffuser opposite side member are coupled to each other, a flange unit for covering the edge of the fan blade unit is formed in the diffuser side member.

BEST MODE FOR CARRYING OUT THE INVENTION

A front suction/discharge type outdoor unit for an air conditioner in accordance with the present invention will now be described in detail with reference to the accompanying drawings.

A louver frame 4 is fixedly installed on a rectangular space inner wall formed on an outer wall 2 of a residential and/or commercial building. An inside area of the louver frame 4 is divided into a suction area 7*a* and a discharge area 7*b*. A plurality of louver blades 8 are installed in each area, so that air can be sucked or discharged through gaps between the louver blades 8. An air suction/discharge direction can be controlled by adjusting a direction of the louver blades 8.

Figure 2:
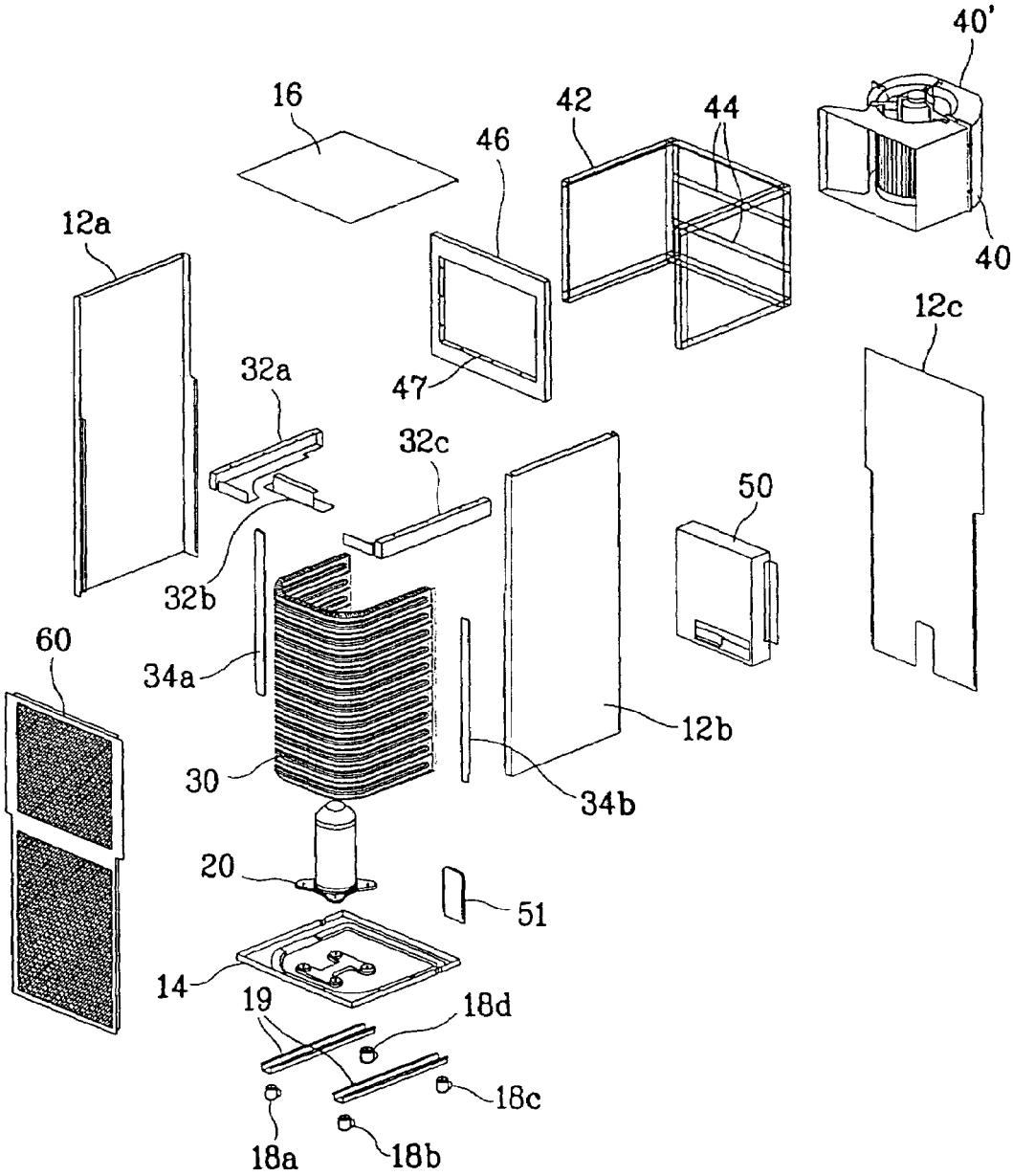
FIG. 2 is a perspective view illustrating disassembly of the outdoor unit of FIG. 1.

On the other hand, the outdoor unit 10 fixedly installed at the inside of the outer wall 2 of the building to contact with the louver frame 4 includes an outdoor unit casing having components of FIG. 2. In addition, outdoor unit components of FIG. 2 are installed in the outdoor unit casing.

In the outdoor unit casing, one side facing the suction area 7*a* and the discharge area 7*b* of the louver frame 4 is opened. The opened side is divided into a suction unit 11*a* and a discharge unit 11*b* to correspond to the suction area 7*a* and the discharge area 7*b* of the louver frame 4. In addition, three side covers 12*a*, 12*b* and 12*c*, a bottom cover 14 and a top cover 16 are closed to form a rectangular parallelepiped. The outdoor unit casing can be divided into a suction casing corresponding to the suction unit 11*a* and a discharge casing corresponding to the discharge unit 11*b*. A plurality of leg members 18*a*, 18*b*, 18*c* and 18*d* are externally protruded from the bottom cover 14. The leg members 18*a*, 18*b*, 18*c* and 18*d* are installed on the bottom of a building, for example a veranda of an apartment building, for supporting heavy load of the outdoor unit 10. Preferably, four leg members 18*a*, 18*b*, 18*c* and 18*d* are formed in consideration of the shape of the bottom cover 14. A leg reinforcing member 19 for connecting and reinforcing the leg members 18*a*, 18*b*, 18*c* and 18*d* is formed below the bottom cover 14 in the horizontal direction. The leg members 18*a*, 18*b*, 18*c* and 18*d* further include screws (not shown) for controlling height. Accordingly, when the bottom of the building, for example the veranda of the apartment building is not flat, they can stably position the outdoor unit 10. When the two leg members 18*a* and 18*b* positioned in the forward direction (toward building outer wall) among the leg members 18*a*, 18*b*, 18*c* and 18*d* further include transport wheels (not shown), it is much easier to transport the heavy load outdoor unit 10.

A compressor 20 is installed in the outdoor unit suction unit 11*a*, and a 'U' shaped air-cooled condenser 30 is fixedly supported on the side covers 12*a* and 12*b* and the bottom cover 14 by using condenser covers 32*a*, 32*b* and 32*c* and condenser brackets 34*a* and 34*b*. In the air-cooled condenser 30, a plurality of condenser pipe lines are formed in a zigzag shape between a plurality of condenser fins. The structure and shape of the air-cooled condenser 30 have been publicly known, and thus are not shown in detail. A refrigerant gas compressed by the compressor 20 is transmitted through the pipe lines of the condenser 30, removed its condensation heat by externally-supplied air, and condensed. In this case, the condenser covers 32*a*, 32*b* and 32*c* and the condenser brackets 34*a* and 34*b* form a wind path so as to prevent external air from being supplied to the discharge unit 11*b* not via the condenser 30. As a result, external air sucked through the gaps between the louver blades 8 of the suction area 7*a* passes through the 'U' shaped condenser 30 along the wind path of the condenser covers 32*a*, 32*b* and 32*c* and the condenser brackets 34*a* and 34*b*, and exchanges heat with the refrigerant gas flowing through the condenser pipe lines.

Figure 1:
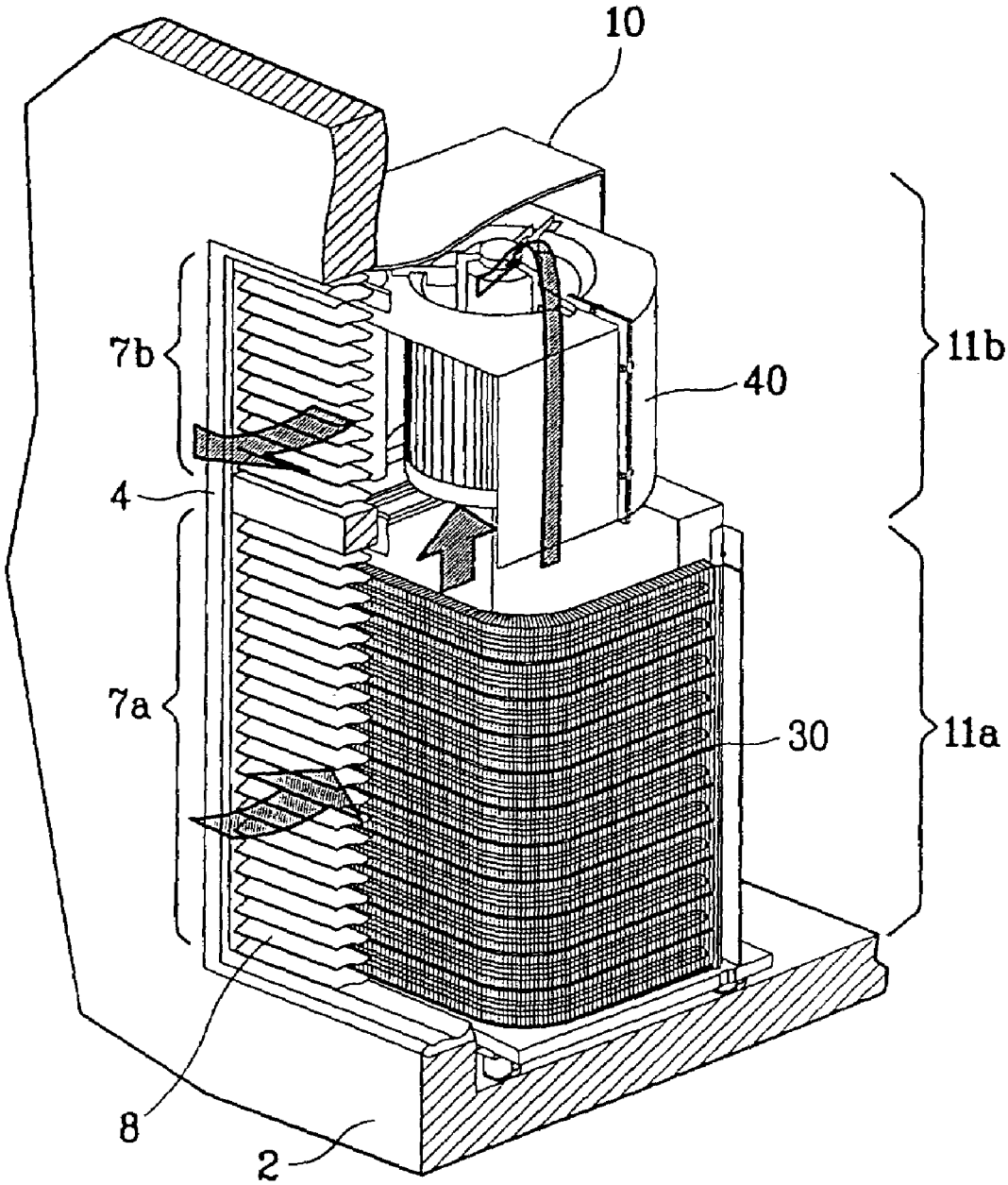
FIG. 1 is a partially-cut perspective-sectional view illustrating a front suction/discharge type outdoor unit for an air conditioner in accordance with the present invention.
Figure 3:
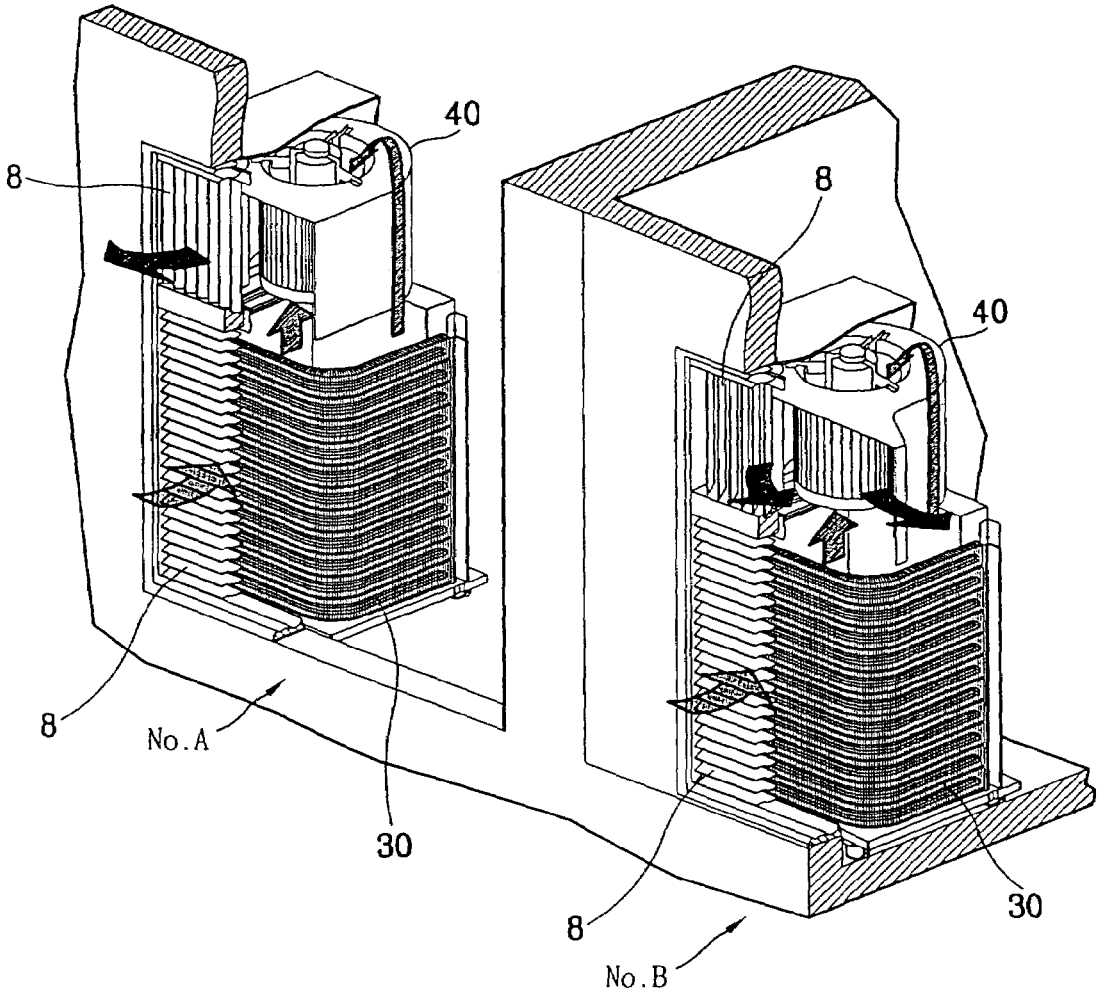
FIG. 3 is an exemplary view illustrating installation of front suction/discharge type outdoor units for air conditioners in accordance with another embodiment of the present invention.

The front suction/discharge type outdoor unit structure of FIG. 1 is obtained by installing the outdoor unit on the louver frame fixed to the rectangular space inner wall formed on the outer wall of the building. However, adjacent houses are symmetrical to each other in a common residential building which has become the main residential type due to city developments. When the outdoor unit of one house is positioned in one side of a veranda, the outdoor unit of the adjacent house symmetrical to the house is positioned in the same side of a veranda. FIG. 3 shows installation of the outdoor units. In the case of a high-rise common residential building of FIG. 4, houses facing each other are symmetrical, and thus outdoor units are adjacent to each other.

Figure 4:
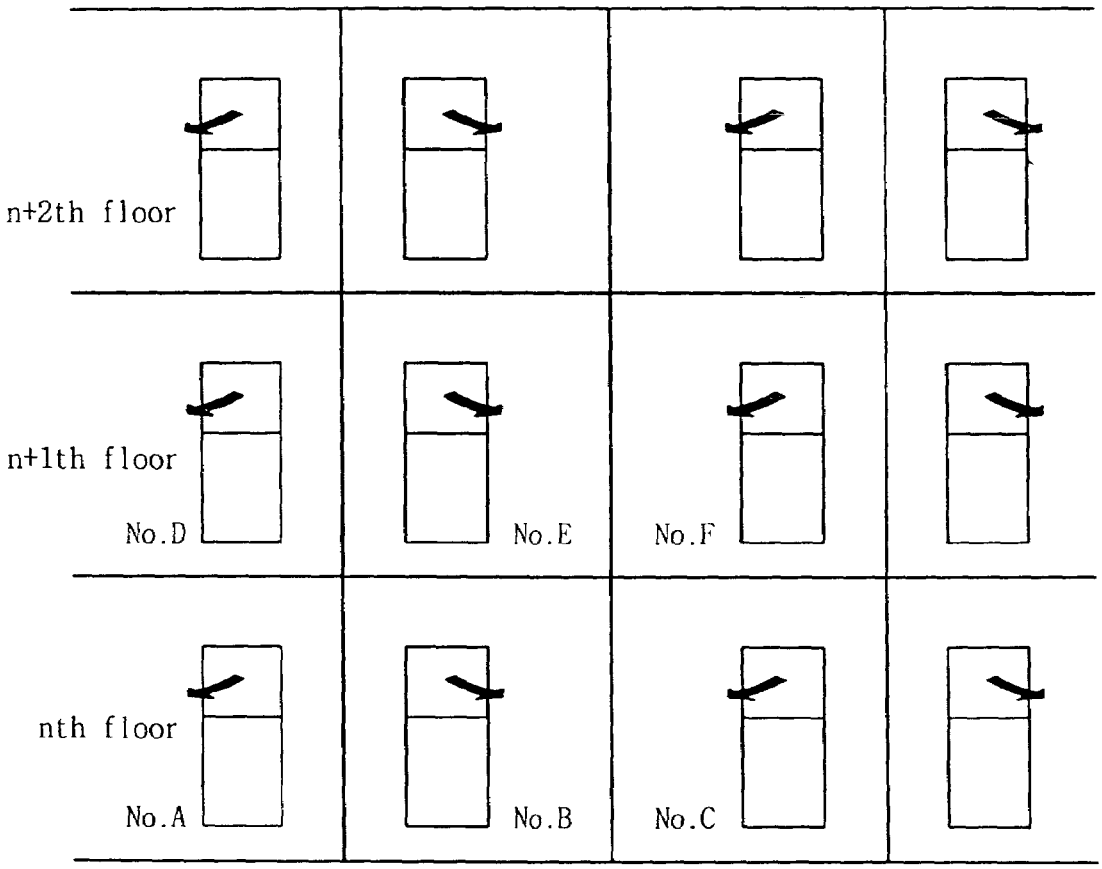
FIG. 4 is a schematic view illustrating preferable discharge directions of waste air from the outdoor units in a common residential building.

Referring to FIG. 4, the outdoor unit is installed at the right side of A on the n-th floor. However, if the outdoor unit is installed at the left side of A, the outdoor unit is installed at the right side of B, and the outdoor unit is installed at the left side of C. As a result, the outdoor units of B and C are adjacent to each other.

Accordingly, when a discharge direction of air from the cooling fan faces the most adjacent outdoor unit, heat exchanged and discharged air is re-sucked through the suction unit of the most adjacent outdoor unit, or the suction unit of the upper floor (n+1 or n+2) outdoor unit, to reduce heat exchange efficiency of the adjacent outdoor unit. That is, not fresh air but high temperature waste air discharged from the lower floor outdoor unit is sucked through the suction unit, which decreases heat exchange efficiency.

In order to solve the foregoing problem, heat exchanged air from the cooling fan is discharged in a distant direction from the most adjacent outdoor unit. Arrows of FIG. 3 indicate discharge directions. As shown in the partially-cut perspective view of FIG. 3, the discharge direction of waste air from the cooling fan of A is opposite to the discharge direction of waste air from the cooling fan of B. Here, when a sirocco cooling fan whose orifices face the up/down directions is used as the cooling fan, a rotation direction of a sirocco cooling fan motor of A must be opposite to a rotation direction of a sirocco cooling fan motor of B. When different types of fan and air guide are used, the most adjacent outdoor units can have opposite discharge directions by controlling a direction of the air guide. Moreover, the louver blades 8 of the discharge unit can be formed in a length direction to reduce a discharge resistance of waste air from the discharge unit. FIG. 3 shows the louver blades 8 of the discharge unit formed in the length direction.

As described above, when the discharge directions of the adjacent outdoor units are controlled, waste air discharged from one outdoor unit (for example, outdoor unit of B) is rarely sucked through the suction unit of the adjacent outdoor unit (for example, outdoor unit of A or C) or the upper floor outdoor unit (for example, outdoor unit of D, E or F) as shown in FIG. 4, which improves heat exchange efficiency of the outdoor units installed in the common residential building.

In this embodiment, the sirocco cooling fan whose orifices are formed in the up/down direction is used as the cooling fan. However, a different kind of fan or guide pipe (for example, axial fan and air guide) can be used to embody the technical ideas of the present invention within the scope as defined in the appended claims.

Differently from the general outdoor unit sucking external air from three sides and discharging heat exchanged air to a top surface, the front suction/discharge type outdoor unit of the invention restricts its suction area, and thus increases a suction resistance in the system. Therefore, the outdoor unit of the invention uses a sirocco cooling fan, instead of using a general axial fan. That is, a sirocco cooling fan 40 for supplying external air to the air-cooled condenser 30 through the suction area 7*a* and discharing heat exchanged air through the discharge area 7*b* is installed in the outdoor unit discharge unit 11*b*. Suction orifices of the sirocco cooling fan 40 face the up/down directions or the side covers 12*a* and 12*b*.

Here, a size of an impeller of the sirocco cooling fan must be increased to increase heat exchange capacity, and thus a size of a housing of the sirocco cooling fan is increased. As a result, a weight and volume of the sirocco cooling fan are increased. Conversely, when the outdoor unit is installed in a restricted space, a size of the outdoor unit casing is decreased, and thus a size of the housing of the sirocco cooling fan is reduced. Accordingly, a size of the impeller is decreased, and thus a weight and volume of the sirocco cooling fan and blast capacity are reduced. However, the present inventors found out that, when a size of the outdoor unit casing was restricted, a blast pressure could be maintained by partially forming a diffuser opposite side curvature unit as a plane unit 40', instead of reducing the size of the impeller of the sirocco cooling fan, and suggested another preferred embodiment of the present invention. In this case, the plane unit 40' reinforces intensity of the housing, and is easily fastened to the outdoor unit casing by minimizing interferences with the outdoor unit casing, as discussed later.

Figure 5:
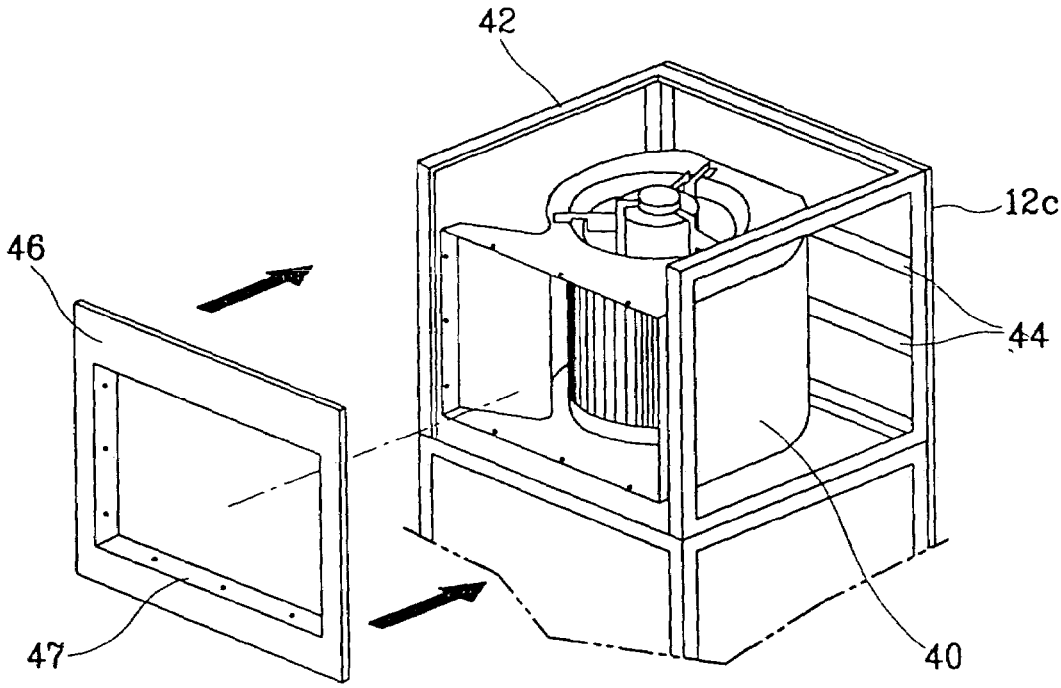
FIG. 5 is an exemplary view illustrating installation of a sirocco cooling fan in a discharge unit of a front suction/discharge type outdoor unit for an air conditioner in accordance with another embodiment of the present invention.
Figure 6:
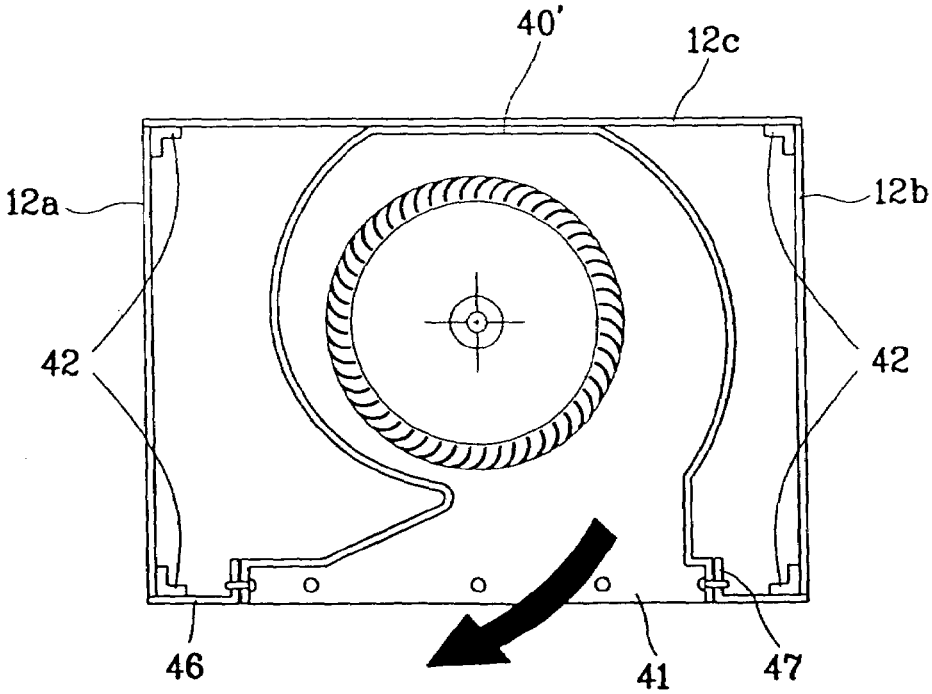
FIG. 6 is an exemplary view illustrating a diffuser opposite side part of a sirocco cooling fan formed as a plane unit in accordance with the present invention.

The suction orifices of the sirocco cooling fan can be installed to face the up/down directions or the side covers 12*a* and 12*b*. FIGS. 1 and 2 show the suction orifices facing the up/down directions. In any case, a fan supporting member for fixing the sirocco cooling fan 40 to the outdoor unit casing is required to minimize vibration of fan operations on the system. The fan supporting member includes a fan frame 42 for reinforcing and supporting the edges of the discharge unit, and a fan bracket 44 for fixedly coupling the plane unit 40' of the sirocco cooling fan 40 to the fan frame 42 (refer to FIGS. 2 and 5). The fan bracket 44 is formed in various shapes according to the installation direction of the sirocco cooling fan 40. Here, the plane unit 40' can be closely adhered and fixed to the inside surface of the side cover 12*c* (refer to FIG. 6). In any case, a fixing area of the fan is wider than when the housing of the fan includes only the curvature unit, thereby efficiently preventing vibration of a blast fan. As described above, when the outdoor unit casing is divided into the suction casing corresponding to the suction unit 11*a* and the discharge casing corresponding to the discharge unit 11*b*, the fan frame 42 reinforces and supports the discharge casing.

Figure 7A:
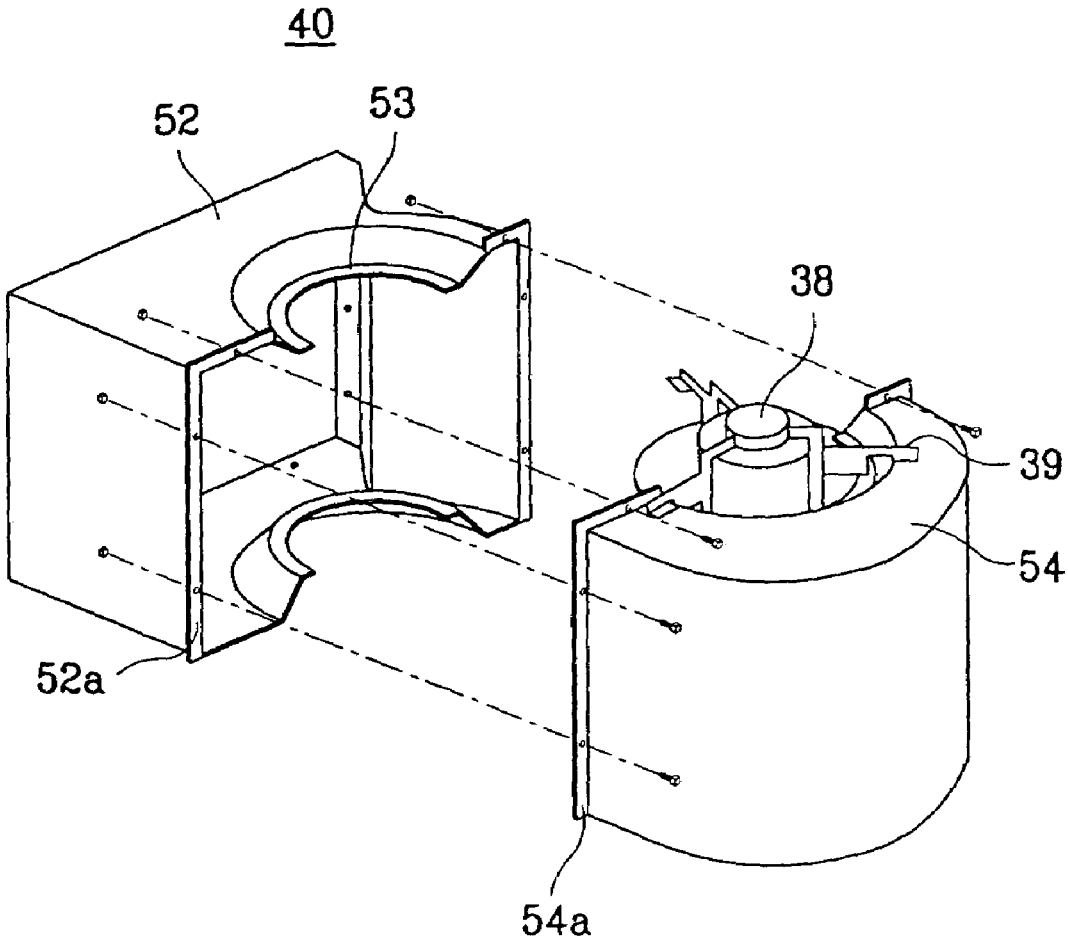
FIG. 7A is a view illustrating housing separation structure of a sirocco cooling fan whose orifices face the up/down directions.
Figure 7B:
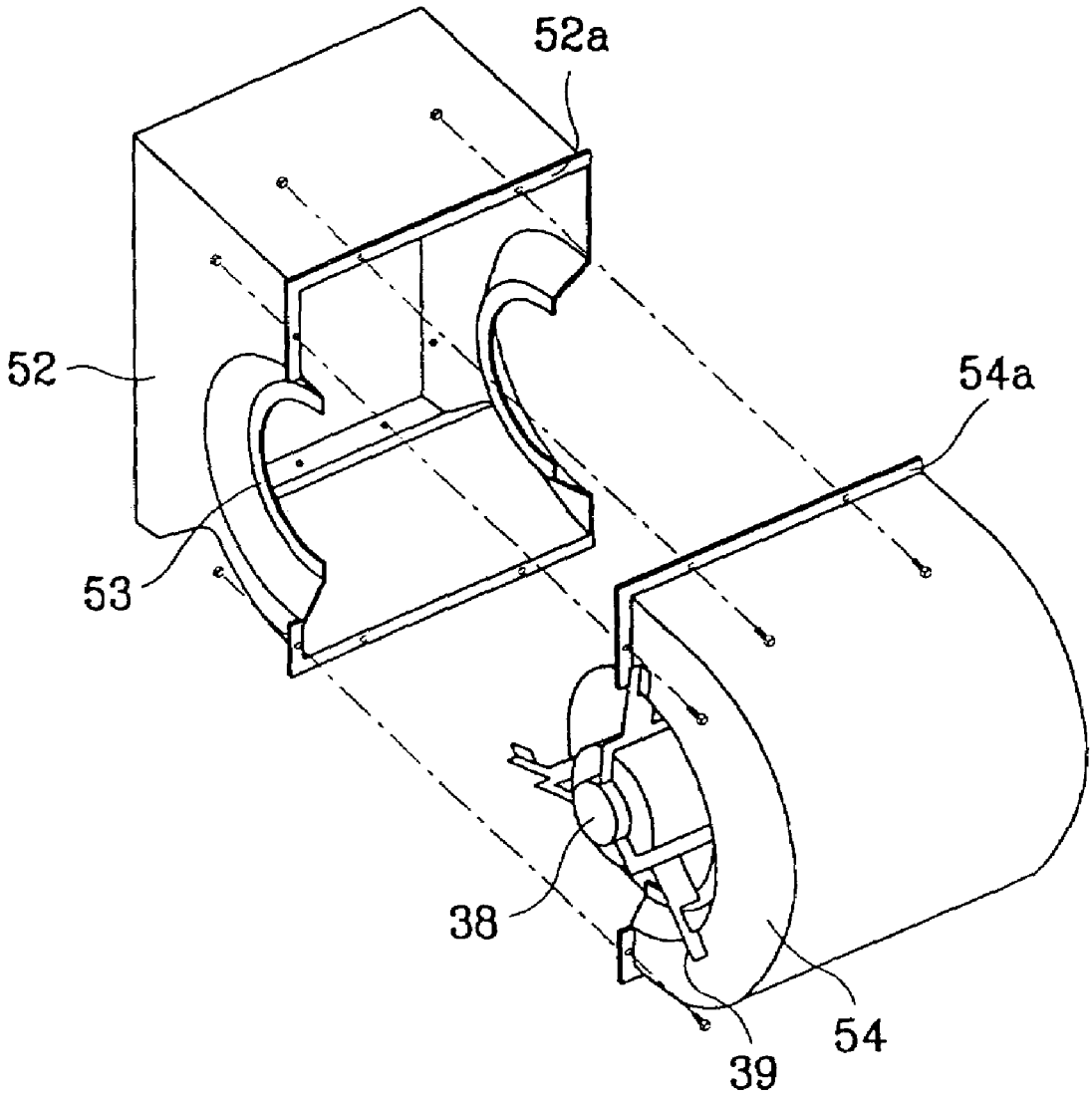
FIG. 7B is a view illustrating a housing separation structure of a sirocco cooling fan whose orifices face both sides.

As depicted in FIGS. 7A and 7B, the housing of the sirocco cooling fan 40 is divided into a diffuser side housing 52 and a diffuser opposite side housing 54.

FIG. 7A shows a state where one of the suction orifices of the sirocco cooling fan faces the surface contacting with one opened surface and being farthest from the suction unit among the other surfaces, and the other orifice faces the suction unit (namely, the suction orifices face the up/down directions in the structure of FIG. 2 where the discharge unit is formed on the suction unit), and FIG. 7B shows a state where the suction orifices of the sirocco cooling fan face the two surfaces contacting with one opened surface among the other surfaces (namely, the suction orifices face both sides in the structure of FIG. 2 where the discharge unit is formed on the suction unit).

In each case, a first flange 52*a* is formed in the diffuser side housing 52, and a second flange 54*a* is formed in the diffuser opposite side housing 54. When the first and second flanges 52*a* and 54*a* stick to each other, the diffuser side housing 52 and the diffuser opposite side housing 54 are coupled to or separated from each other by using a plurality of fastening means. In this case, one of fan mounts 39 supporting the cooling fan motor 38 is fixed to the diffuser side housing 52, and the other two fan mounts 39 are fixed to the diffuser opposite side housing 54. Therefore, the diffuser side housing 52 is firstly installed, the diffuser opposite side housing 54 is coupled to the diffuser side housing 52 in a state where the fan motor and blade unit are fixed to the diffuser opposite side housing 54 by the fan mounts 39, and the other fan mount 39 is fixed to the diffuser side housing 52. The disassembly process is performed in a reverse order. A number of the fan mounts 39 can be changed. It should be recognized that the diffuser opposite side housing 54 is coupled to or separated from the diffuser side housing 52 in a state where the fan motor and blade unit are fixed to the diffuser opposite side housing 54.

Here, third flanges 53 are respectively formed in the orifices of the diffuser side housing 52 and the diffuser opposite side housing 54. When the two housings are coupled, the third flanges 53 cover the edge of the fan blade unit, and serve as a guide of air sucked into the fan blade unit.

Figure 8:
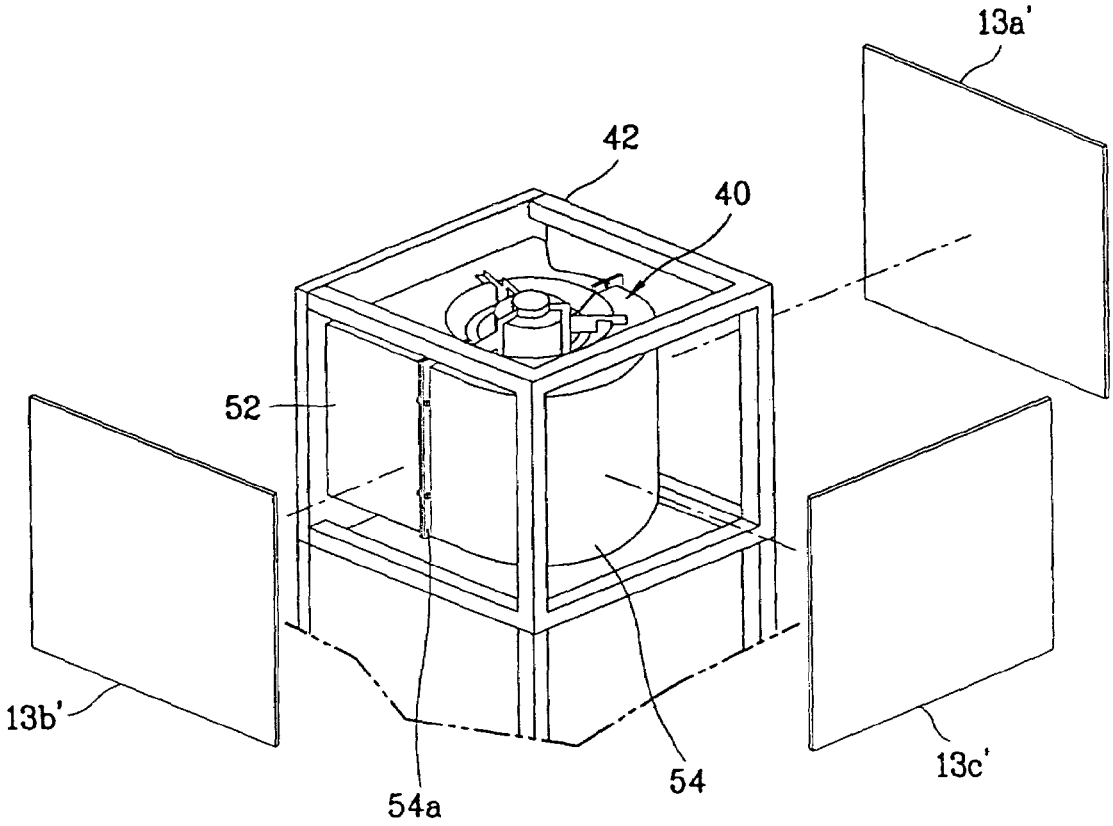
FIG. 8 is a view illustrating a discharge casing on which a sirocco cooling fan is mounted in accordance with another embodiment of the present invention.

As illustrated in FIG. 8, when one 13*c'* of top side covers 13*a*', 13*b'* and 13*c'* of the discharge casing is separated, the fastening means fastened to the first and second flanges 52*a* and 54*a* are released, and the fan mount 39 is separated from the diffuser side housing 52, the diffuser opposite side housing 54, the fan motor and the blade unit can be easily separated in the diffuser opposite side, and thus easily repaired and replaced. In addition, the assembly process can be easily performed in a reverse order.

Reference numeral 46 denotes a fan front installed in front of the sirocco cooling fan 40. Connecting members 47 are formed in the fan front 46, to be fastened to the end of the discharge unit of the sirocco cooling fan 40.

A control box 50 for controlling the operation of the outdoor unit 10 is installed at the inside of the side cover 12*b* composing the rear surface among the side covers, and refrigerant pipe lines which the refrigerant gas evaporated in the indoor unit is sucked through, and a valve assembly 51, a path of the refrigerant pipe lines which the refrigerants condensed in the outdoor unit 10 are discharged through are installed below the control box 50.

The operation of the front suction/discharge type outdoor unit for the air conditioner will now be explained.

The refrigerant gas inputted from the indoor unit through the refrigerant pipe lines of the valve assembly 51 is compressed in the compressor 20 and supplied to the condenser 30. Because the cooling fan 40 is operated, external air sucked through the gaps between the louver blades 8 of the suction area 7*a* evenly passes through gaps between the fins formed on the three surfaces of the 'U' shaped condenser 30 through the wind path of the condenser covers 32*a*, 32*b* and 32*c* and the condenser brackets 34*a* and 34, increases its temperature by taking condensation heat from the refrigerant gas flowing through the condenser pipe lines inserted between the fins, passes through the cooling fan 40, and is externally discharged through the gaps between the louver blades 8 of the discharge area 7*b*.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A front suction/discharge type compressor/condenser unit for an air conditioner, comprising:

a compressor/condenser unit casing provided separate from an indoor unit that includes an evaporator, wherein the compressor/condenser unit casing is formed in a substantially rectangular parallelepiped shape, with one side open and its remaining sides closed;

a compressor provided in the compressor/condenser unit casing and configured to compress a refrigerant gas supplied from the separate indoor unit;

an air-cooled condenser positioned in the compressor/condenser unit casing and configured to condense the refrigerant gas from the compressor; and a fan assembly installed in the compressor/condenser unit casing and configured to supply external air to the air-cooled condenser and to discharge heat exchanged air, wherein the fan assembly comprises a fan provided in a fan housing, and wherein the fan assembly can be configured to selectively discharge air through the open side of the compressor/condenser unit in a direction away from an open side of a most adjacent compressor/condenser unit on a same floor.

2. A front suction/discharge type compressor/condenser unit for an air conditioner, comprising:

a compressor/condenser unit casing provided separate from an indoor unit that includes an evaporator and having a substantially rectangular parallelepiped shape, with one side open and its remaining sides closed, wherein the compressor/condenser unit casing is configured to be divided into a suction unit and a discharge unit;

a compressor provided in the compressor/condenser unit casing and configured to compress refrigerant gas supplied from the separate indoor unit;

an air-cooled condenser positioned in the compressor/condenser unit casing and configured to condense refrigerant gas from the compressor; and a fan assembly provided in the compressor/condenser unit casing and configured to supply external air to the air-cooled condenser, and to discharge heat exchanged air, wherein the fan assembly can be configured to selectively discharge air through the open side of the compressor/condenser unit in a direction away from an open side of a most adjacent compressor/condenser unit on a same floor.

3. The compressor/condenser unit of claim 2, wherein the fan assembly comprises a sirocco fan positioned in a fan housing, the fan housing comprising a curved unit which includes a portion which follows a curvature of the sirocco fan, and a substantially planar vertical portion.

4. The compressor/condenser unit of claim 2, wherein the fan assembly comprises a sirocco fan, and a fan housing comprising a diffuser side member and a diffuser opposite side member.

5. The compressor/condenser unit of claim 2, wherein the fan assembly comprises a sirocco fan having two suction orifices, wherein a line which connects centers of the two suction orifices is substantially parallel to a vertical axis of the open side of the compressor/condenser unit.

6. The compressor/condenser unit of claim 2, further comprising a louver frame, wherein the louver frame is configured to be positioned on an outer wall of a building so as to face the suction unit and the discharge unit of the compressor/condenser unit casing, and wherein the louver frame comprises:

a suction area and a discharge area corresponding to the suction unit and the discharge unit of the compressor/condenser unit casing, respectively; and a plurality of louver blades in each area such that air is sucked in and discharged through gaps formed between adjacent louver blades.

7. The compressor/condenser unit of claim 6, wherein the louver blades of the discharge area are positioned in a transverse direction across the discharge area of the louver frame.

8. The compressor/condenser unit of claim 5, wherein a rotation direction of a motor of the sirocco fan of the compressor/condenser unit can be selected such that the rotation direction of a fan of a first compressor/condenser unit is the opposite of a rotation direction of a sirocco fan motor of a second adjacent compressor/condenser unit.

9. A front suction/discharge type compressor/condenser unit for an air conditioner, comprising:

a compressor/condenser unit casing formed in a substantially rectangular parallelepiped shape, with one side open and its remaining sides closed;

a compressor installed in the compressor/condenser unit casing and configured to compress a refrigerant gas supplied from an indoor unit through pipe lines;

an air-cooled condenser positioned in the compressor/condenser unit casing and configured to condense the refrigerant gas from the compressor; and a fan assembly installed in the compressor/condenser unit casing and configured to supply external air to the air-cooled condenser, and to discharge heat exchanged air, wherein the fan assembly comprises a fan positioned in a fan housing and a diffuser provided in the housing, the fan housing comprising a first side housing and a second side housing, wherein a portion of the first side housing opposite the diffuser is substantially planar and the second side housing proximate the diffuser corresponds to a curvature of the fan.

10. The compressor/condenser unit of claim 9, wherein the fan assembly can be configured to selectively discharge air through the open side of the compressor/condenser unit in a direction away from an open side of a most adjacent compressor/condenser unit.

11. The compressor/condenser unit of claim 9, wherein the second side housing is coupled to the first side housing of the fan.

12. The compressor/condenser unit of claim 9, wherein the fan is a sirocco fan and is configured to be fixed to the fan housing upon coupling the first and second side housings by a bracket which extends between the fan and the first and second side housings.

13. The compressor/condenser unit of claim 9, wherein the substantially planar portion of the first side housing is closely positioned on a corresponding inside surface of the compressor/condenser unit casing.

14. A front suction/discharge type compressor/condenser unit for an air conditioner, comprising:

a compressor/condenser unit casing provided separated from an indoor unit that includes an evaporator and formed in a substantially rectangular parallelepiped shape, with one side open and its remaining sides closed;

a compressor installed in the compressor/condenser unit casing and configured to compress a refrigerant gas supplied from the separate indoor unit;

an air-cooled condenser positioned in the compressor/condenser unit casing and configured to condense the refrigerant gas from the compressor; and a fan assembly installed in the compressor/condenser unit casing and configured to supply external air to the air-cooled condenser, and to discharge heat exchanged air, wherein the fan assembly comprises a sirocco fan installed in a fan housing and a diffuser provided in the fan housing, the fan housing comprising a first diffuser opposite side member coupled to a second diffuser side member, the fan housing corresponding to a curvature of the fan.

15. The compressor/condenser unit of claim 14, wherein the fan assembly can be configured to selectively discharge air through the open side of the compressor/condenser unit in a direction away from an open side of a most adjacent compressor/condenser unit.

16. The compressor/condenser unit of claim 14, wherein the first diffuser opposite side member comprises a portion which is substantially planar so as to be closely positioned on a corresponding inside surface of the compressor/condenser unit casing.

17. The compressor/condenser unit of claim 14, further comprising a first flange unit formed on the first diffuser opposite side member, and a corresponding second flange unit formed on the second diffuser side member, wherein the first flange unit and corresponding second flange unit are configured to be engaged so as to couple the first diffuser opposite side member and the second diffuser side member.

18. The compressor/condenser unit of claim 14, wherein the sirocco fan is configured to be coupled to the first diffuser opposite side member when the first diffuser oppoiste side member and the second diffuser side member are decoupled.

19. The compressor/condenser unit of claim 17, further comprising, a third flange unit configured to cover a peripheral edge of the diffuser so as to support the second diffuser side member when the first diffuser opposite side member and the second diffuser side member are coupled, and when the first diffuser opposite side member is decoupled from the second diffuser side member.

20. An installation system for installing a plurality of front suction/discharge type compressor/condenser units for air conditioners on each floor of a plurality of floors of a building, each compressor/condenser unit respectively comprising:

a compressor/condenser unit casing provided separate from an indoor unit that includes an evaporator and formed in a substantially rectangular parallelepiped shape, with one side open and its remaining sides closed;

a compressor installed in the compressor/condenser unit casing and configured to compress a refrigerant gas supplied from the separate indoor unit;

an air-cooled condenser positioned in the compressor/condenser unit casing and configured to condense the refrigerant gas from the compressor; and a fan assembly installed in the compressor/condenser unit casing and configured to supply external air to the air-cooled condenser, and to discharge heat exchanged air, wherein the fan assembly can be selectively configured to discharge air through the open side of the compressor/condenser unit in a direction away from an open side of a most adjacent compressor/condenser unit on the same floor.

21. The system of claim 20, wherein the fan assembly comprises a sirocco fan having two suction orifices, wherein a line connecting centers of the two orifices is substantially parallel to a vertical plane of the open side of the compressor/condenser unit.

22. The system of claim 21, wherein a rotation direction of a motor of the sirocco fan of a compressor/condenser unit can be selectively changed such that a rotation direction of a fan of a compressor/condenser unit is the opposite of a rotation direction of a fan motor of its most adjacent compressor/condenser unit on the same floor.

* * * * *